United States Patent [19]

Nineberg et al.

[11] Patent Number: 4,694,947

[45] Date of Patent: Sep. 22, 1987

[54] DUMP CHUTE ASSEMBLY

[75] Inventors: Edward Nineberg, Evanston; Mark Menaker, Chicago, both of Ill.

[73] Assignee: ML Corporation, Chicago, Ill.

[21] Appl. No.: 778,798

[22] Filed: Sep. 23, 1985

[51] Int. Cl.[4] ..... B65G 11/20; F23G 5/00

[52] U.S. Cl. ..... 193/34; 110/116; 110/256

[58] Field of Search ..... 193/34; 110/108, 116, 110/117, 176, 256, 173 C; 126/190; 49/379, 386; 220/326, 224, 348, 323, 1 T

[56] References Cited

U.S. PATENT DOCUMENTS

| | | | |
|---|---|---|---|
| 596,686 | 1/1898 | Thompson | 193/34 |
| 1,880,370 | 10/1932 | Breitwieser | 193/34 |
| 1,928,962 | 10/1933 | Carter | 110/108 X |
| 3,561,162 | 2/1971 | Goldman | 49/386 |
| 3,742,875 | 7/1973 | Eberle | 193/34 X |
| 3,800,328 | 3/1974 | Harlan et al. | 49/386 X |

*Primary Examiner*—Jeffrey V. Nase

*Attorney, Agent, or Firm*—Emrich & Dithmar

[57] ABSTRACT

A dump chute assembly includes an outer radially-shaped housing having an access door and an inner pivotally movable radially-shaped chute member. The inner chute member includes a sealing panel which seals the assembly from the incinerator chimney. Control member is provided for operatively rotating the inner chute member to the dumping position in the interior of the chimney and the collection position exterior of the chimney.

14 Claims, 12 Drawing Figures

DUMP CHUTE ASSEMBLY

BACKGROUND OF THE INVENTION

The present invention relates to a novel dump chute assembly for depositing combustible waste material into an incinerator chimney.

Apartments, condominiums, office buildings and similar structures include an incinerator in the basement area of the building and a chimney extending upwardly through the various floors thereof to the roof of the building. Each floor of the building includes an access opening to the chimney by which garbage or trash may be deposited into the chimney for subsequent incineration. The incinerator is generally a gas burner or the like which requires sufficient draft to permit the gases to be dispelled from the chimney during combustion.

Several prior art structures have been suggested as hopper assemblies or dump chutes for communicating with the interior of the incinerator chimney. U.S. Pat. Nos. 1,530,787, 1,880,370, 1,297,360 and 2,081,554 describe hopper doors which are pivotally secured to an opening in the chimney which permit the hopper door to open and refuse to be deposited therein. When the hopper door is pivotally closed, the hopper portion of the door permits the refuse to slide into the chimney of the incinerator. Although such structures are simple in construction, such hopper devices interfere with the necessary draft created during incineration and permit the passage of fumes and other impurities past the hinged hopper structures into the floor of the building.

To overcome the deficiencies such hinged structures, U.S. Pat. No. 2,161,412 describes a structure for use in conjunction with a conventional hopper door wherein, when the hopper door is opened for placement of refuse therein, there is admitted pass the opened door, through an operable damper valve, a draft to the chimney during incinerator. Such a structure attempts to prevent ash and fumes from passing out the incinerator door opening when refuse is deposited therein. U.S. Pat. No. 3,812,979 describes a further apparatus for preventing fumes and smoke leakage from chimneys having a conventional dump chute wherein the device includes a separate enclosure surrounding the dump chute with means subjects the interior of the enclosure to a slight positive pressure to overcome the pressure differences in the chimney and prevent fumes and material from escaping through the incinerator chute opening. Such complicated structures which require separate blowers for maintaining positive pressures around the incinerator chute opening are expensive and inefficient in operation in that they do not seal the incinerator opening to prevent escapage of fumes and the like from the incinerator into the hallway or floor space of the building.

SUMMARY OF THE INVENTION

It is one object of the present invention to provide a novel dump chute assembly for use in conjunction with an incinerator chimney which includes an inner radially-shaped chute member pivotally mounted within an outer radially-shaped housing and pivotally moveable between a closed sealing position wherein the chute assembly is sealed from the incinerator to a dumping position wherein the refuse or contents in the inner radially-shaped chute member is deposited into the incinerator chimney.

It is another object of the present invention to provide a novel dump chute assembly having external control means operatively connected to an inner radially-shaped chute member to pivotally move the chute member from a closed sealing position to the chimney of an incinerator to a dumping position wherein the refuse or contents of the inner radially-shaped chute member is deposited in the incinerator chimney.

It is still another object of the present invention to provide a novel radially-shaped outer housing mounted to a housing enclosure or door jamb, the outer housing having an opening in the top thereof engageable with door member pivotally mounted and operable between a closed position closing said opening in the top of the outer housing and an open position permitting access to the radially-shaped outer housing.

It is still another object of the present invention to provide a dump chute assembly wherein the external access door to the dump assembly and the internal sealing panel include sealing means thereon for engagement with the dump chute assembly to provide a substantially air tight seal between the chute assembly and the incinerator chimney.

It is a further object of the present invention to provide a novel dump chute assembly wherein external control means is mounted on the sidewall of an outer radially-shaped housing for pivotally moving an inner chute member between a sealed closed position and a dumping position wherein the refuse or contents within the chute member is deposited into an incinerator chimney.

Another object of the present invention is to provide a novel dump chute assembly comprised of an outer radially-shaped housing adapted to receive a pivotally mounted inner radially-shaped housing which is pivotally moveable between a closed position wherein the dump chute assembly is sealed from the chimney of the incinerator to an open dumping position wherein the refuse or contents within the chute assembly is deposited within the chimney of the incinerator.

It is yet another object of the present invention to provide a novel dump chute assembly wherein other and further objects of the present invention will be apparent from the following description and claims which are illustrated in the accompanied drawings, which by way of illustration, show the preferred embodiment of the present invention and the principles thereof in which we consider to be the best mode in which we have comtemplated applying these principles. Other embodiments of the present invention embodying the same or equivalent principles may be used for structural changes may be made as desired by those skilled in the art without departing from the present invention and the purview of the appended claims.

DETAILED DESCRIPTION

Figure 1:
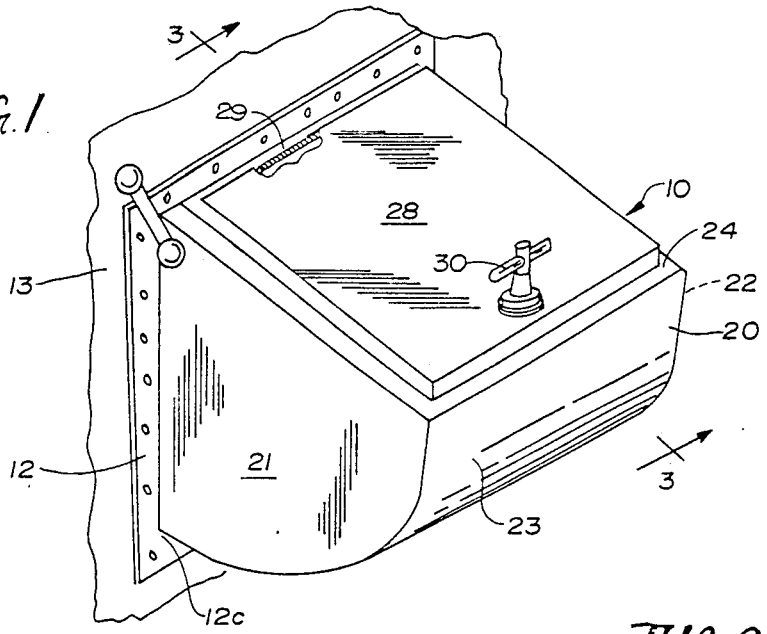
FIG. 1 is a perspective view of the dump chute assembly in accordance with present invention.
Figure 3:
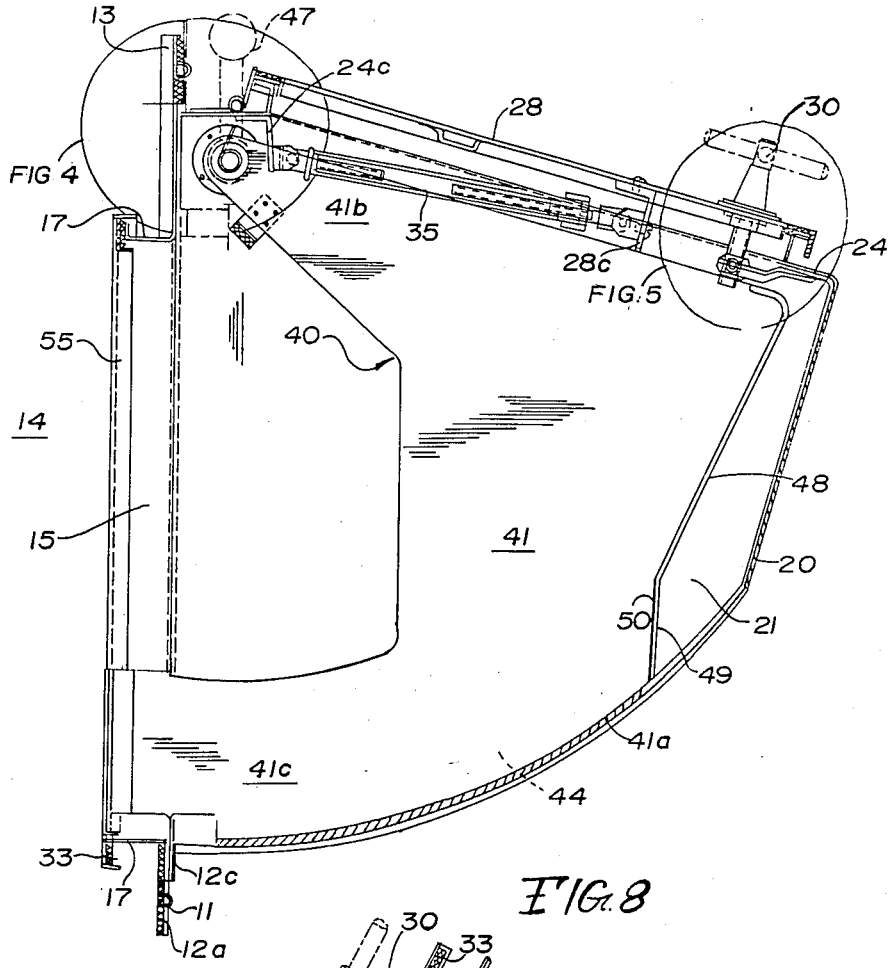
FIG. 3 is a sectional view taken substantially along lines 3—3 of FIG. 1.
Figure 7:
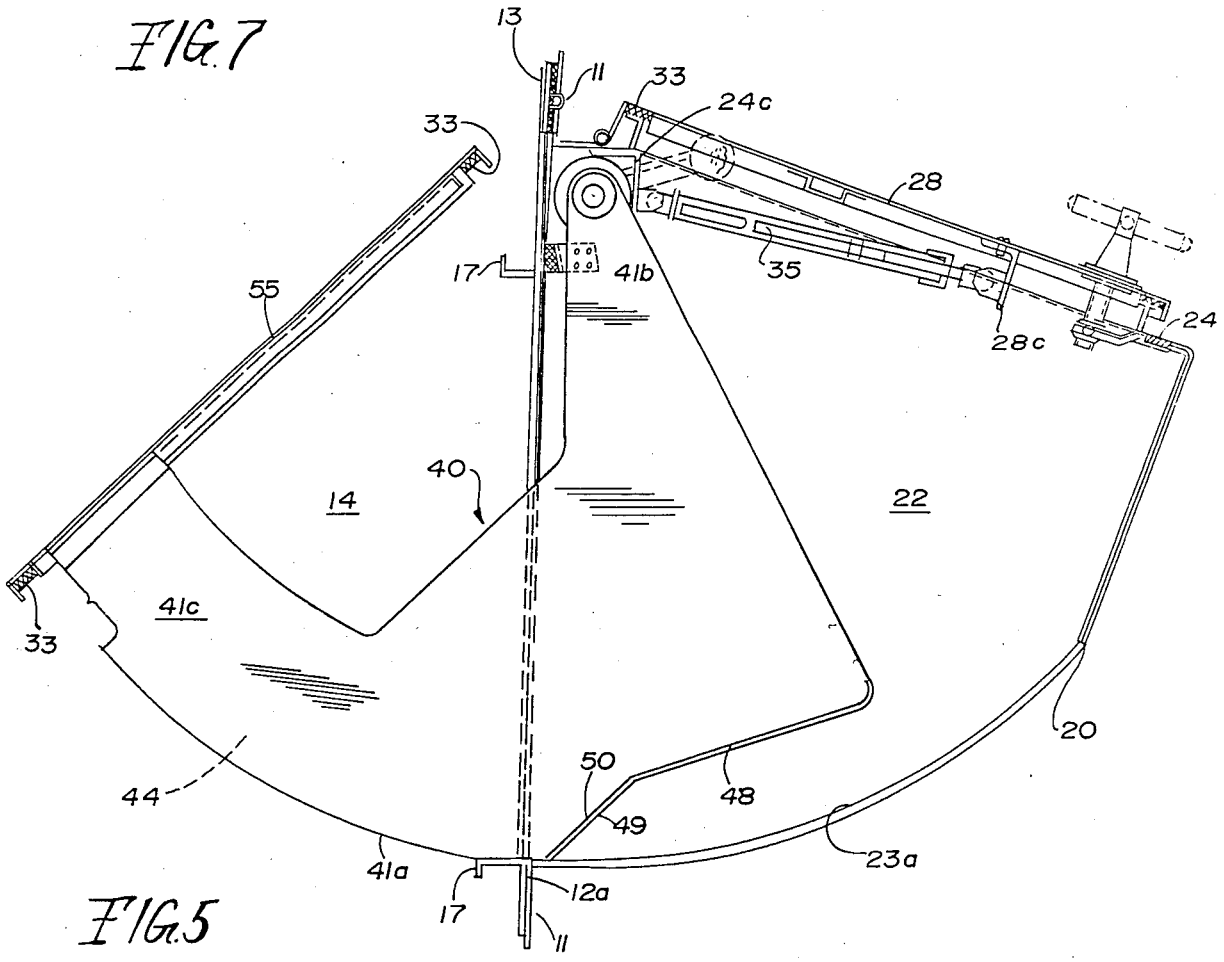
FIG. 7 is a fragmentary cross-sectional view showing the inner radially-shaped member positioned in the dumping position to permit refuse and the like to be deposited within the chimney of the incinerator.

With reference now to the several drawings wherein like numerals have been used throughout the several views to designate the same or similar parts, a dump chute assembly 10 is shown in FIG. 1 mounted and attached to a housing door jamb or enclosure 12 which is mounted into the wall 13 of an incinerator chimney 14 to define a rectangular-spaced opening 15. As shown in FIGS. 1, 3 and 7, the dump chute assembly 10 is mounted to the outside facing 12*a* of the housing door jamb or enclosure 12 by screws or other fastening means 11 and the housing door jamb or enclosure 12 includes angled extensions 17 (FIG. 7) which protrude inwardly into the incinerator chimney 14 to cooperate with a sealing panel 55 to seal the dump chute assembly 10 from the interior of the incinerator chimney 14, as will hereinafter be described.

Figure 2:
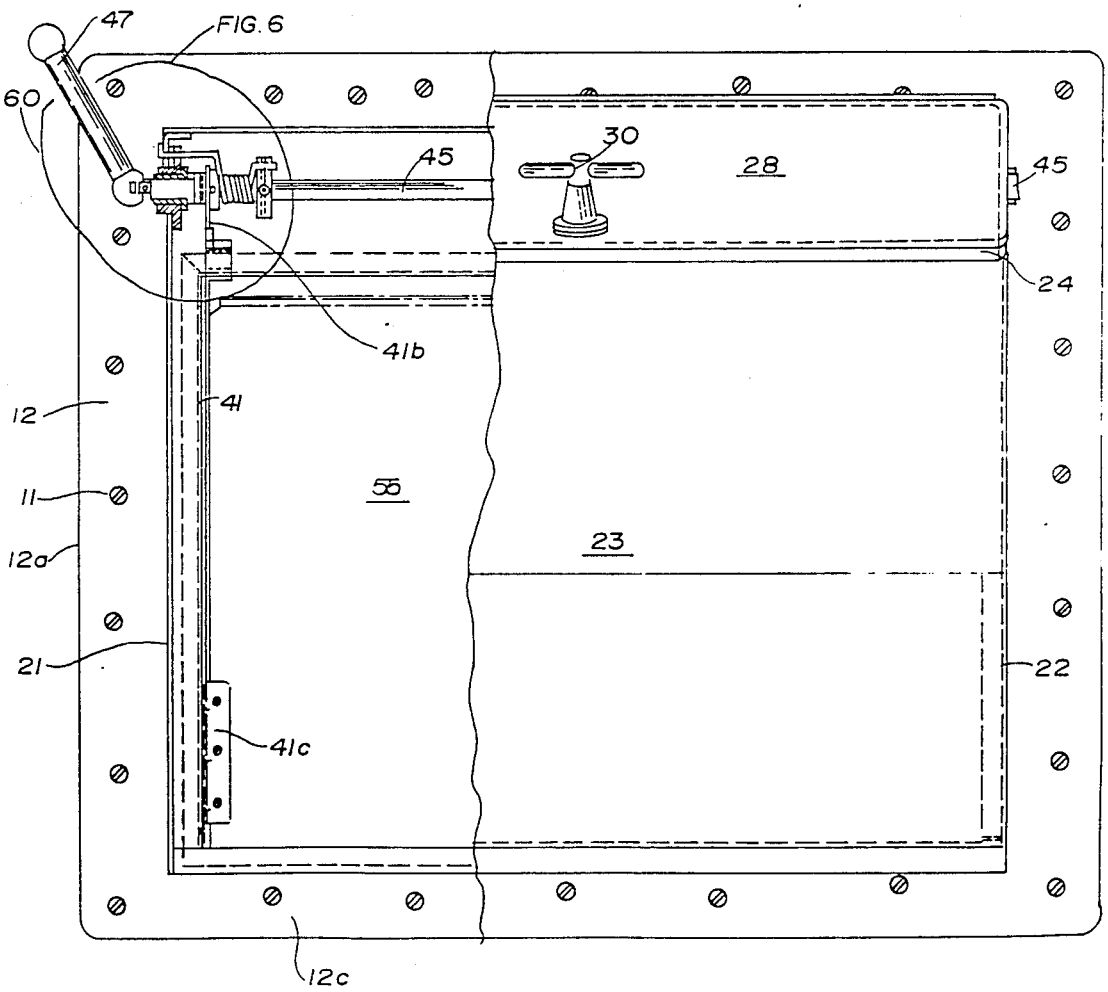
FIG. 2 is a front elevational view of the dump chute assembly shown in FIG. 1 with a position broken away.
Figure 4:
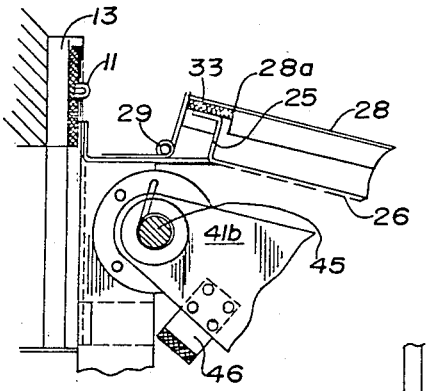
FIG. 4 is an enlarged view of the portion encircled and identified as FIG. 4 in FIG. 3.
Figure 8:
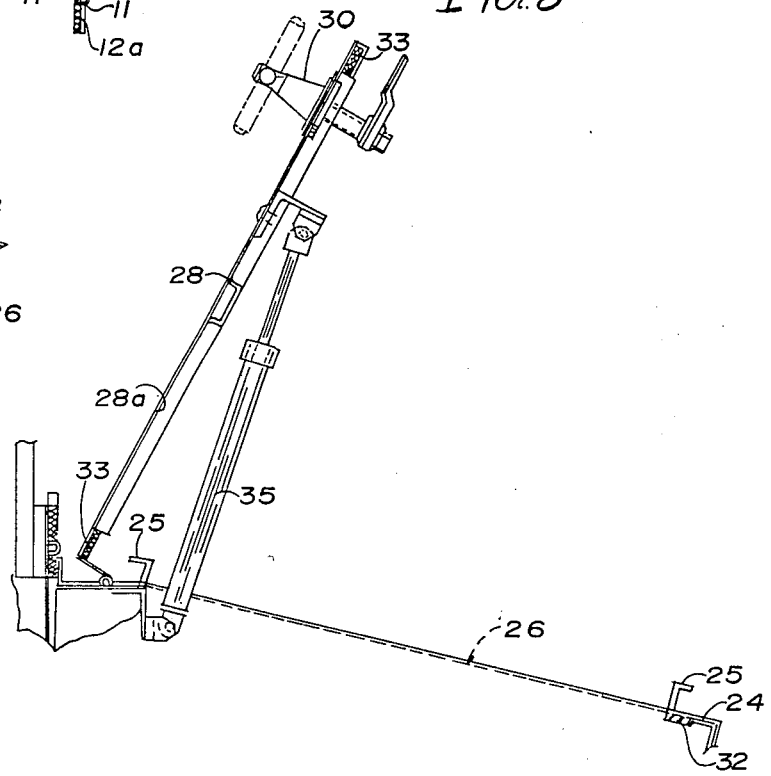
FIG. 8 is a fragmentary cross-sectional view showing the door member in accordance with the present invention in the open position to permit refuse and the like to be deposited within the dump chute assembly in accordance with the present invention.
Figure 5:
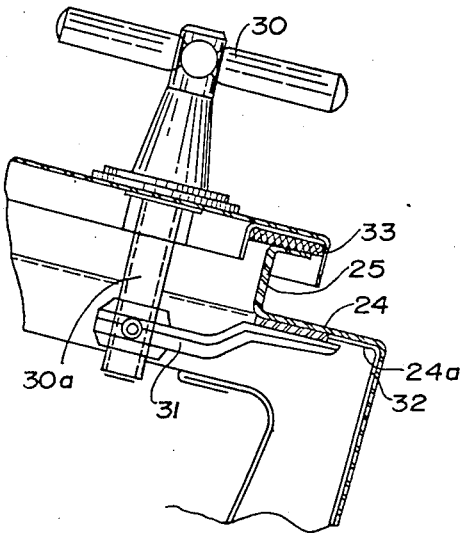
FIG. 5 is an enlarged view of the circled portion identified as FIG. 5 in FIG. 3.

As shown in FIGS. 1 and 2, the dump chute assembly 10 includes an outer radially-shaped housing 20 comprised of two substantially parallel sidewalls 21 and 22 mounted perpendicularly to the housing enclosure 12 and radially-shaped frontal wall 23 extending radially outwardly and upwardly from the bottom 12*c* of the housing enclosure 12. The parallel sidewalls 21 and 22 and the frontal wall 23 terminate and provide a top surface 24 having an angled extension 25 (FIG. 5) extending substantially thereabout to define a rectangular-shaped opening 26 (FIG. 8) through which refuse and the like may be inserted into the dump chute assembly 10, as will hereinafter be described. A door member or means 28 is pivotally mounted to hinge 29, best shown in FIG. 4, to sealingly engage the rectangular-shaped opening 26 of the outer radially-shaped housing 20, as shown in FIGS. 1, 2, 3, 5 and 7. As shown in FIG. 5, the door member or means 28 includes a rotatable handle 30 which has an extension 30*a* thereon to which is attached a lever or latch member 31 which may be rotated to engage a pad 32 mounted on the lower surface 24*a* of the top 24. When the door member or means 28 is fully latched and closed with respect to the top 24 of the outer radially-shaped housing 20, the angled extension 25 is positioned and adapted to cooperate and engage a resilient member or means 33 positioned about the edges of the inner surface 28a of the door member 28 to substantially provide an airtight seal between the door member 28 and the top 24 of the outer radially-shaped housing 20, as shown in FIG. 5. Preferably, the door member 28 includes a spring piston member 35 mounted between an extension member 28*c* extending downwardly from the interior of the door member 28 and an extension member 24*c* extending downwardly from the top 24 of the outer radially-shaped housing 20, as shown in FIGS. 3 and 7. As shown in FIG. 8, when the rotatable handle 30 is rotated to release lever 31 from the pad 32 on the lower surface 24*a*, the piston spring 35 pivotally biases the door member 28 from the closed position to the open position, the position as shown in FIG. 8. Although the drawings illustrate the hinged member 29 mounted to the top 24 of the outer radially-shaped housing 20, it is within the scope of the present invention that the door member or means 28 may include an extension member (not shown) such that the door member may be hingedly mounted from the housing door jamb or enclosure 12.

As shown in FIGS. 2, 3 and 7, the dump chute assembly 10 includes an inner radially-shaped chute member 40 comprised of a pair of parallel spaced end plates 41, substantially in a C-shaped configuration, each of the plates 41 having an outward radially surface 41*a* which is radially dimensioned such that when an extension portion 41*b* of the plates 41 is secured to a pivotally rotatable shaft 45, the parallel spaced end plates 41 are pivotally moved or rotated from a closed position, as shown in FIG. 3, to a fully opened position, the position as shown in FIG. 7.

Each of the parallel spaced end plates 41 are inner connected together by a pusher wall 48 which includes a blade portion 49, as shown in FIGS. 3 and 7. The pusher wall innerconnects th radial surfaces 41*a* of the end plates 41 substantially at the midpoint of the arc of the outer radial surfaces 41*a* thereof. The space between the spaced end plates 41 in front of the blade surface 49 through to the end plate extensions 41*c* define an opening 44, shown in dotted lines in FIGS. 3 and 7 through which refuse may be dropped into the incinerator chimney 14 when the inner radially-shaped chute member 40 is in the full dumping position to permit the contents or refuse within the dump chute assembly 10 to be deposited in the incinerator chimney. Fixedly mounted to the forward ends of extensions 41*c* of the parallel spaced end plates 41 is a sealing panel or door 55 which is adapted to pivotally move away from engagement of the angled extension 17 surrounding the housing door jamb or enclosure 12, as shown in FIG. 3, to a fully opened positioned, as shown in FIG. 7, when the inner radially-shaped chute member 40 is in the forward dumping position. The sealing panel or door 55 is preferably rectangular in shape and includes a resilient sealing member or means 33 positioned thereon for engagement with the angled extensions 17 on the housing enclosure 12 when the dump chute assembly 10 and the inner radially-shaped chute member 40 is in the closed position, the position as shown in FIG. 3. When in the closed position, the sealing panel 55 prevents leakage of any kind from the incinerator chimney.

Figure 6:
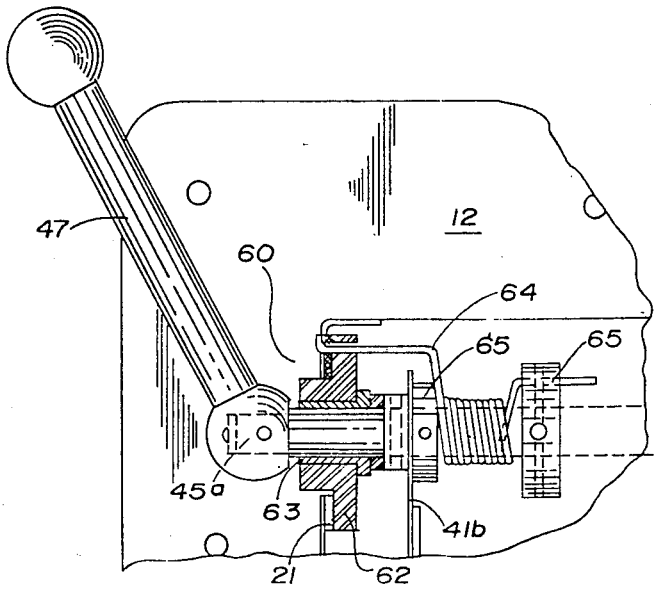
FIG. 6 is an enlarged fragmentary view showing the control means for moving the inner radially-shaped member in accordance with the present invention.
Figure 9:
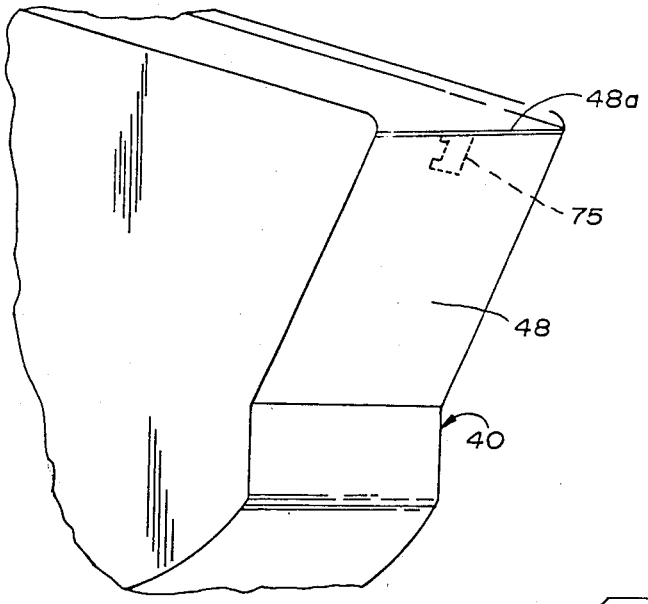
FIG. 9 is a perspective view of the inner radially-shaped chute member in accordance with the present invention.

Control means 60 is best shown in reference to FIGS. 2 and 6 and includes a shaft 45 is mounted to the parallel sidewalls 21 and 22 of the outer radially-shaped housing 20. The shaft is mounted within a sleeve bushing 62 which contains a bearing 63 therein to permit rotational movement of the shaft 45 and axially retain the shaft within the parallel sidewalls 21 and 22 respectively, as shown in FIG. 6. Mounted onto the shaft 45 adjacent each end thereof is the extension 41b of the spaced end plates 41 in FIG. 6 are the parallel spaced end plate for rotational movement when the shaft 45 is rotated. Mounted to the shaft end 45 is a control handle 47. As shown in dotted lines 47 in FIG. 3, the handle is substantially in a vertical position when the inner radially-shaped chute member 40 is in the closed position and the sealing panel 55 is engaged to the housing door jamb 12 to seal the chute assembly from the interior of the incinerator chimney. As shown in FIG. 7, when the control handle is pulled the shaft 45 rotates with the simultaneous pivotal rotation of the inner radially-shaped chute member 40 to a position where the contents within the chute assembly is deposited into the interior of the incinerator chimney 14.

Additionally, the control means 60 includes a torsion spring 64 mounted on the shaft 45 and confined thereto by a pair of collar members 65. Thus, upon the rotational movement of the control means 60 through the control handle 47 and the shaft 45, the torsion spring 64 biases and returns the inner radially-shaped chute member 40 from the fully engaged dumping position wherein the contents within the chute assembly is deposited into the chimney of the incinerator, as shown in FIG. 7, back to the original at rest position wherein the sealing panel or door 55 is sealed against the angled extension 17 of the housing door jamb 12, as shown in FIG. 3. Addtionally, as shown in FIG. 4, the extension portion **41*b* of the parallel end plates 41 of the inner radially-shaped chute member 40 may include a projection member 46 thereon which is adapted to engage the housing door jamb or enclosure 12 when the inner chute member 40 is in the dumping position to provide a positive stop means during the rotational movement of the inner radially-shaped chute member 40**.

Additionally, as shown in FIGS. 3 and 7, the blade surface 49 of the pusher wall 48 preferably includes a rubber covering 50 on the facing thereof to provide a seal between the pusher wall and the inner surface of the outer frontal wall **23*a* during the pivotal movement of the inner chute member to prevent refuse and the like from wedging between the outer radially-shaped housing 20 and the inner radially-shaped chute member 40**.

In operation of the present invention, it is preferred that the user rotate the rotatable handle to disengage the lever or latch member 31 from the inner surface from the top of the housing to pivotally move the door member 28 away from the rectangular-shaped opening 26, to the position as shown in FIG. 8. After the refuse and contents have been deposited within the dump chute assembly 10, the door member 28 is pivotally moved downward and the latch member or lever 31 is again rotated to engage the inner surface of the top 24 of the outer radially-shaped housing 20 to seal the door member 28 thereto. Thereafter, the control handle 47 is rotated and pulled away from the vertical position, as shown in FIG. 3, such that the inner radially-shaped chute member 40 is moved from the closed to the fully opened position wherein the contents within the chute assembly is deposited within the incineration chimney 14, the position as shown in FIG. 7.

Figure 11:
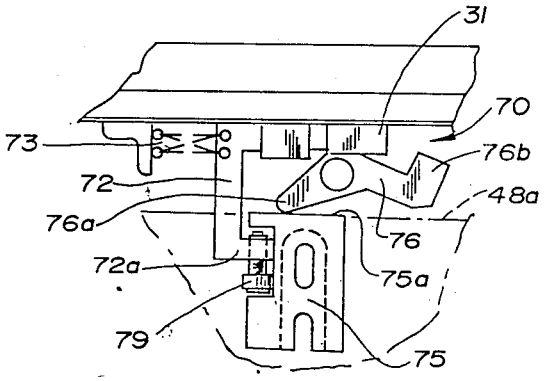
FIG. 11 is an enlarged fragmentary view showing the safety interlock system locking the inner chute member in the closed position for depositing refuse into the chute assembly in accordance with the present invention.

Alternatively, as shown in FIGS. 9–12, a safety interlock control means 70 may be provided between the latch member 31 on door member or means 28 and an interlocking bracket member 72 mounted to the lower surface **24*a* of the top 24. The bracket member 72 is slidably mounted and biased by a spring 73 to a closed position as shown in FIG. 11, and the member 72 includes an extension 72*a* thereon which is adapted to cooperate and engage a hook member 75 mounted on the top edge 48*a* of the pusher wall 48 of the chute member 40. Pivotally mounted to the radially-shaped housing 20 and extending forwardly between the top of 75*a* in hook member 75 and the bracket member 72 is a cam member 76. The cam member 76 is biased by a spring member 78 so that a portion 76*a* engages the top 75*a* of the hook member 75. The cam member includes a latch retention portion 76*b***.

Figure 12:
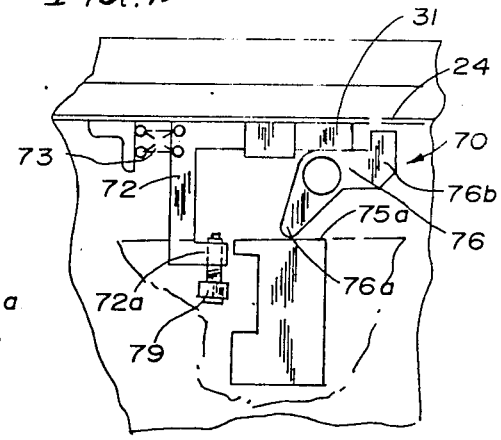
FIG. 12 is an enlarged fragmentary view showing the safety interlock system releasing the inner chute member to the open dumping position in accordance with the present invention.
Figure 10:
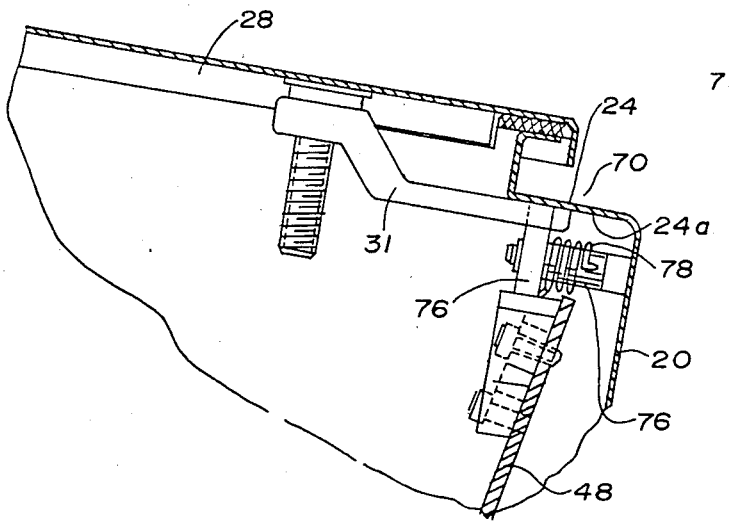
FIG. 10 is an enlarged cross-sectional view showing a safety interlock system in accordance with the present invention.

In operation, when the door 28 is open permitting the depositing of refuse into the chute assembly 10, the bracket member 72 and extension **72*a* is biased to the closed position (FIG. 11) wherein the extension 72*a* is engaged with the hook member 75. Extension 72*a* may include an adjustment means 79 to provide aligned engagement with the hook member 75. Upon partial engagement of latch member 31 with the lower surface 24*a* of the top 24, the latch member engages the end 72*b* of the bracket member 72, the position as shown in FIG. 11. Upon the full engagement of the latch member 31 with the lower surface 24*a*, the latch member slidably moves bracket member 72 and the extension 72*a* out of engagement with the hook member 75. The cam member 76 is rotated by spring 78 to cause portion 76*a* to pivotally move the chute member 40 towards the open position, as shown in FIG. 12. The rotation of the cam 76 causes the latch retention portion 76*b* to rotate and lock the latch member 31 in the closed position thus preventing the opening of the door member 28 during the refuse dumping operation. When the refuse has been deposited within the incineration chimney 14, as shown in FIG. 7, the chute member 40 returns to the closed position and the top 75*a* of the hook member rotates the cam 76 to the position as shown in FIG. 11. Simultaneously, the spring 73 biases the bracket member 72 to the closed poosition whereby the extension 72*a* engages the hook member 75 and the operator is free to rotate the handle and open the door 28. Thus, the interlock control means prevents opening of the door member 28 during the pivotal movement of the chute member 40**.

Thus, the novel dump chute assembly in accordance with the present invention provides a unique chute assembly wherein the refuse of the like may be readily deposited and placed into an incinerator chimney without the creation of any drafts which would affect the operation of the incinerator and which provides structure which seals the chute assembly and the surrounding environment from the escape of smoke, fumes, soot or the like from the incinerator during operation.

We claim:

1. In an incinerator chimney having an opening therein for permitting refuse to be deposited therein, including in combination, a dump chute assembly comprising a housing enclosure mounted to the incinerator chimney about the opening in the incinerator chimney, a radially-shaped outer housing mounted to said housing enclosure and extending outwardly therefrom and having an opening at the top thereof, a door means pivotally mounted and operable between a closed position closing said opening at the top of outer housing and an open position permitting access to the outer housing, an inner radially-shaped chute member having an opening therethrough, said chute member being pivotally mounted within said radially-shaped outer housing and having a sealing panel mounted thereon forwardly of said opening and within the incinerator chimney, said sealing panel on said chute member being positioned for engagement with said opening in the incinerator chimney to seal the chute assembly from the incinerator chimney, and control means operatively connected to said inner radially-shaped chute member to pivotally move the same and said sealing panel thereon from a closed sealing position, wherein said outer housing prevents the flow of material through said opening in said inner chute member, to a dumping position wherein said sealing panel is moved to an open position away from the opening in the incinerator chimney and said opening in said inner chute member is positioned in the chimney and the material in said inner radially chute member is deposited into the incinerator chimney.

2. Apparatus in accordance with claim 1 wherein said door means further includes a latch member engageable with said outer housing and spring means for biasing said door from said closed position to said open position when said latch member is disengaged from said outer housing.

3. Apparatus in accordance with claim 1 wherein assembly further includes interlock control means and said door means includes a latch member engageable with said interlock control means for maintaining said door means in a closed locked position during the pivotal movement of said chute member to said dumping position.

4. Apparatus in accordance with claim 1 wherein said door means in pivotally mounted to said top of said outer housing.

5. Apparatus in accordance with claim 1 wherein said door means is pivotally mounted to said housing enclosure.

6. Apparatus in accordance with claim 1 wherein said door means and said sealing panel include sealing means positioned thereon for engagement with said openings in the top of said outer housing and defined by said housing enclosure, respectively, to substantially provide an airtight seal with the incinerator chimney.

7. Apparatus in accordance with claim 1 wherein said outer housing is comprised of two substantially parallel sidewalls mounted perpendicularly to said housing enclosure and a radially-shaped frontal wall interconnecting the sidewalls and shaped to extend radially outwardly from said housing enclosure.

8. Apparatus in accordance with claim 7 wherein said control means includes a shaft member extending between said sidewalls of said outer housing and said inner chute member is mounted thereon for pivotal movement between said closed position and said dumping position.

9. Apparatus in accordance with claim 8 wherein said control means further includes a handle member mounted to the end of said shaft member for pivotally moving said shaft member and said inner chute member between said closed position and said open position.

10. Apparatus in accordance with claim 9 wherein said control means further includes spring means to bias and return said shaft member and said inner chute member from said open position to said closed position.

11. Apparatus in accordance with claim 10 wherein said spring means is a torsion spring mounted on said shaft and retained thereon by collar means.

12. Apparatus in accordance with claim 1 wherein said inner radially-shaped chute member includes a pair of parallel aligned end plates secured to said control means for pivotal movement thereby, said end plates each including a radially-shaped edge thereon, with said end plates being interconnected together by a pusher wall with said pusher wall and said end plates pivotally mounted within said radially-shaped outer housing.

13. Apparatus in accordance with claim 12 wherein said pusher wall includes a rubber material mounted thereon to provide a seal between said pusher wall and said outer housing during the pivotal movement of said inner chute member.

14. Apparatus in accordance with claim 1 wherein said inner radially-shaped chute member includes a projection member thereon which is adapted to engage said housing enclosure when said inner chute member is in the dumping position to provide a position stop for said inner radially-shaped chute member.

* * * * *